United States Patent [19]

Perez Blanco

[11] Patent Number: 5,009,415

[45] Date of Patent: Apr. 23, 1991

[54] RECREATIONAL GYMNASTIC APPARATUS

[75] Inventor: Juan M. Perez Blanco, Sevill, Spain

[73] Assignee: Internacional de Technicas y diseno, S.A., Sevill, Spain

[21] Appl. No.: 406,731

[22] Filed: Sep. 13, 1989

[30] Foreign Application Priority Data

| | | | |
|---|---|---|---|
| Sep. 16, 1988 | [ES] | Spain | 8802751 |
| Sep. 30, 1988 | [ES] | Spain | 8802896 |
| Jan. 5, 1989 | [ES] | Spain | 8900023 |

[51] Int. Cl.[5] ..... A63B 25/08

[52] U.S. Cl. ..... 272/114; 280/1.182

[58] Field of Search ..... 272/114, 93; 280/218, 280/1.182

[56] References Cited

U.S. PATENT DOCUMENTS

| | | | |
|---|---|---|---|
| 2,971,773 | 2/1961 | McKissick | 272/114 |
| 3,179,409 | 4/1965 | Marino | 272/114 |
| 3,371,927 | 3/1968 | Ryan et al. | 272/114 |
| 3,712,634 | 1/1973 | Simmons | 280/1.182 |
| 4,076,270 | 2/1978 | Winchell | 280/218 |

*Primary Examiner*—Stephen R. Crow

*Attorney, Agent, or Firm*—Darby & Darby

[57] ABSTRACT

A recreational gymnastic apparatus is made up of a support platform for the user and an elastic rebounding element which is mounted under the platform, forming a support for the unit of the floor. The rebounding element is preferably a resilient ball, and it is mounted within a hemispherical, open bottom housing formed in the platform so as to receive the ball. An arm projects upwardly at an acute angle with respect to the platform and terminates in handlebars at its upper end.

4 Claims, 1 Drawing Sheet

RECREATIONAL GYMNASTIC APPARATUS

OBJECT OF THE INVENTION

As is expressed in the title of this specification, the present invention refers to a recreational gymnastics apparatus and it is especially conceived to carry out jumping exercises which should be generated by body impulses of the user who rests his feet on a platform foreseen for this purpose in the bottom part of the apparatus and such a way that one's hands grasp a handlebar located in the top part thereof.

The jumps which the user mounted on the apparatus in question effects, caused by body impulses, are strenghthened by the recovery, after the deformation, of elastic means which give rise to a bouncing of the apparatus each time it rests on the floor.

One game part of this apparatus, aside from the one that advances with jumps, is the one of maintaining balance, whose attainment is gratifying and creates a certain addiction while one improves in one's exercise.

It is an object of the invention that one gets the unused apparatus in a position of balance and that the apparatus is moved forward upon the elastic means recovering after the bounce, permitting apparatus to advance, helped by the user's more or less skillful movements.

BACKGROUND OF THE INVENTION

There are presently apparatus based on the concept put forth in the previous section and among them one can cite the ones made up of one or two telescopic bars which in one end have a handlebar and in the other an elastic support on the floor, a spring or similar element being associated to the unit which collaborates with the impulses that the user must give to carry out the jumps and in short the exercises which are to be carried out. These apparatus are normally elements which slide vertically with regard to their point of support on the floor and as a general rule the user rests his feet in some stirrups so that for its use and not to lose stability or verticality, it is obvious that a great force in the user's legs is required and in turn great skill, since upon having a very small and unstable point of support it is rather frustrating to use one's greatest strength to keep balance without hardly being able to advance, swing to the difficulties and limitations of movements which this apparatus requires.

Other present-day apparatus of this type are made up of two frames joined in at an angle, one of which practically slides in a vertical position and has at its top a handlebar, while the other, forming an angle with the previous one, has the corresponding stirrups. This apparatus has at its bottom and solidly connected to the frames, some plug supports without including the recovery springs to increase the force of the jump.

DESCRIPTION OF THE INVENTION

The apparatus of the invention is basically constructed with a single body functioning as a general support, which has two separate sections forming an acute angle between them. Upon the section considered as the bottom one, which can be said to remain positioned practically horizontal when the apparatus is being used, is fixed a support platform for the user, with which the elastic means are related. The section considered as the top one has handlebars at its free end.

The angle which the sections of the support body form can be a fix one, upon forming the two sections from a unitary, elbow-shaped piece. Alternatively, an angle range which is selectively adjustable can be achieved if the sections are mutually articulated and there are blocking means of the chosen angular position. If one desires, one or both sections can in turn be extendible, in order to permit the perfect adaptation of the apparatus to the user's characteristics, and above all to attain a fold-up characteristic to take up as little space as possible during the moving or storage of the same. Nevertheless, the sections have to be as rigid as possible for easy handling, since any degree of flexibility would absorb part of the bounce.

The support platform for the user's feet has a housing which receivers a rubber ball which defines the elastic means which enters the bottom surface of the former. Close to the area where both sections of the bottom come together, the bottom section supporting the platform has two small arms which makes it possible to stably rest the apparatus on three points, the ball and these front arms. The ball remains inserted in the platform in order to prevent its accidental emergence given that the intake hole has a diameter slightly smaller than that of the ball. When a ball presses on a point, as is known this point undergoes a deformation towards the inside and the rest of the ball a deformation towards the outside with the force vectors directed towards the pressure point and when this pressure ceases all the force tend to recover their normal state, pushing the pressed point so that it recovers its original form.

The housing which has the platform to receive the ball has a generally hemispherical shape which does not have the rear half, supporting the user's weight with only the front top part of the ball, so that upon the ball recovering after the bounce, it automatically pushes the apparatus forward. Therefore, the ball does not move upward due to a spherical spindle shape band, although it could remain simply retained by a band that forms a type of handle but directed towards the front upper part of the ball and which will support the user's weight. In both cases, the rear top part of the ball would remain free in order to be able to insert one's hand when one wishes to remove the ball from the apparatus, given that with this arrangement it is also possible to remove the ball from the apparatus in order to double the usefulness of the same.

The platform includes on the top some anchors for the user's feet, from which one can easily free himself if so desired.

The side arms of the apparatus, which function as legs, as indicated before, form together with the elastic element defined by the ball, a stable base at rest, as a tripod. These side legs can have in turn an elastic support element and even some small wheels to facilitate carrying and/or displacement during the use of the apparatus.

The platform has a slight incline in an ascending ramp towards the rear part of the apparatus so that upon the user stepping on it, it acquires a horizontal position and raises from the floor the small front legs in order to be able to jump.

In order to facilitate an understanding of the features of the invention and forming an integral part of this specification, the accompanying drawing is provided in the figures of which, with an illustrative and non-restrictive character the following has been represented:

DESCRIPTION OF THE PREFERRED EMBODIMENT

Figure 1:
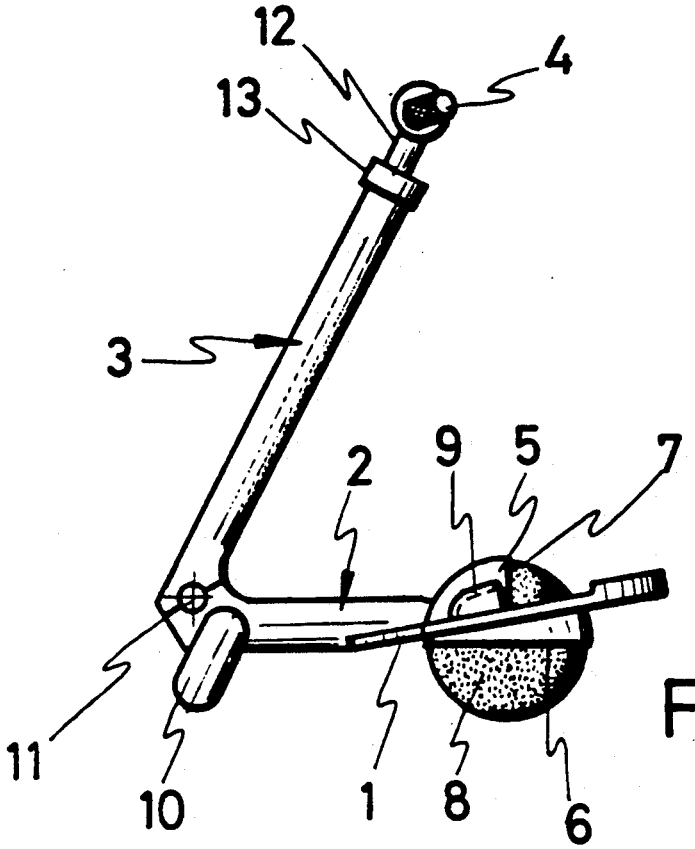
FIG. 1 is a side elevational view of the recreational gymnastic apparatus object of the invention.
Figure 2:
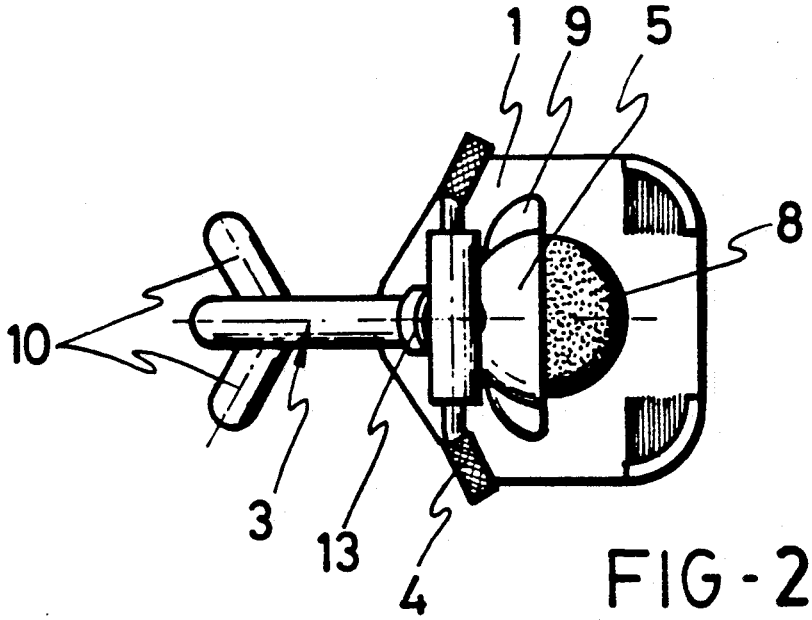
FIG. 2 is a top plan view of what is shown in FIG. 1.

Making reference to the numbering which is indicated in the above cited figures, we can see that the recreational gymnastic apparatus which forms the object of the invention is formed by a support body formed by two arms or sections which form between themselves an acute angle. The arms are referred to in general by numbers 2 and 3 and can be articulated to facilitate the folding thereof and thus occupy a minimal space when the apparatus is not being used.

The lower section 2 which occupies practically a horizontal position has the support platform 1 for the user's feet solidly connected to it, who rests his hands on the grips of a handlebar 4 solidly connected to the free end of the other arm or section 3.

The platform 1 has a housing to fasten the elastic element defined by the ball 8 in this example of the preferred embodiment. The ball 8 remains duly secure in the housing of the platform 1 upon entering through a hole 6 with a diameter slightly smaller than that of the ball and rests its top part in the cavity defined by a general hemispherical shape, materialized by a band 5, which is independent or which forms part of the material itself which constitutes the platform, occupying a surface with a spherical spindle shape which covers the front top half of the ball 8, as is clearly seen in the figures.

The user's feet touch the platform 1 by some very simple fastenings shaped as a hook which traps the foot in the inside front part and in such a way that one's heel remains located in a small recess foreseen in the rear part of the platform and preferably limited in the back by a small arched retention wall. Depending on whether the user turns his foot outward or inward, pivoting over his own heel, the retention is fastened or loosened.

The rear top part of the ball 8 is made visible through a window 7, thanks to which the freeing of the ball is easily attained upon exerting manual pressure on it. Upon the ball 8 being freed from the apparatus, the usefulness of this is doubled since only the ball can be played with.

The horizontal section 2 of the general frame or support body includes a pair of short front and side legs 10, which together form with the elastic element defined in this case by the ball, three stable points of support on the floor, in the condition of non-use of the apparatus, both with the user resting on the platform 1, or else, even when this position has not been attained.

Precisely due to the fact that the platform 1 adopts an inclined position with regard to the floor, remaining raised in the rear, when the user has gotten on it, the same becomes horizontal and the front legs 10 rise simultaneously, due to the user's own weight which makes the platform pivot on the elastic element 8 and to later be able to carry out a series of jumps.

As we indicated at the beginning, due to the fact that the top part of the ball 8 is inserted in a general hemispherical form from which the rear part defined by the window 7 is missing, therefore, the user's weight is supported on the front part made up of the fastening band 5 in the form of a spherical spindle, upon the ball recovering after the bounce, the gymnastic apparatus is moved forward permitting it to move forward helped by the user's skillful movements.

With this arrangement, the user can advance jumping or rest since for the latter one need only grasp the handlebar and move the body slightly forward so that the apparatus rests on the small arms 10. Doing the same one can also jump without any problem of balance and without advancing which makes it possible to learn faster.

The side legs 10 can have, if so desired, an elastic support element and even some small wheels to facilitate movement; these elements have not been represented in the drawings in order not to unnecessarily complicate them.

The arms 2 and 3 of the frame of the gymnastic apparatus can form part of the same piece and therefore have an invariable angle, or else, upon being defined as two independent elements articulated together at 11 in order to mainly facilitate folding up, since as was said before in the position of use they must remain blocked. The arms 2 and 3, or at least one of them and preferably arm 3 holding the handlebar, as shown in the figures, are extendible to adjust and set the effective length at will. In the particular case that the figures show, the capacity of extension and withdrawal of the arm 3 is attained upon the element 3 being formed by a tube-shaped section in which the tube 12 holding the handlebar 4 runs telescopically. The blocking is attained by tightening the nut 13.

In the example shown in the figures, the ball 8 exceeds the offerings that would be attained with another flat elastic element and therefore with a larger support base on the floor and which even comes to occupy the whole platform. In this case, upon automatically attaining the stable position the support legs 10 would not be needed. The features derived from the use of the ball 8 as an elastic means, also overcome the ones attained with a spring located in the vertical axis of the ball which it would replace, though one or several of these elastic elements could be coupled without exceeding the spirit of the invention.

I claim:

1. A recreational gymnastic apparatus of the type in which a user makes successive jumps generated by his body's impulses against and so as to cause the deformation of elastic means which, in their subsequent recovery, cause the combined effect of jumping and advancing of the apparatus, said apparatus, comprising:

a support body having an upright top section and a generally horizontal bottom section joined together to form an acute angle;

a support platform for the user mounted on the bottom section rearwardly of the top section;

the platform having one of an inlay and a housing with a generally hemispherical shape, a mouth facing downward and a window at the rear;

an elastic element including a rubber ball received in said mouth, which fits right in said housing through its mouth;

the window being formed in such a way that the ball rests only on the front half of the hemispherical shape; and fastening means for the user's feet comprising hook means open on one side for receiving the front of a user's foot and a recess in the platform corresponding to the hook means for receiving the heel of the foot;

handle means for being grouped by the user formed at the top of said top section.

2. A recreational gymnastic apparatus, according to claim 3, in which the bottom section has near its front a pair of side legs extending laterally so as to define together with the elastic element a three-point support for the apparatus on the floor.

3. A recreational gymnastic apparatus, according to claim 4, in which the platform is constructed so that in the non-use position of the apparatus it is slightly inclined with regard to the horizontal, rising backward, so that when the user gets on the platform it pivots rearwardly on the elastic element and in turn the front legs rise up from the floor.

4. A recreational gymnastic apparatus, according to claim 1, in which at least the top section is extendible in order to allow adjustment and setting at will of the effective length thereof.

* * * * *